United States Patent [19]

Norcia et al.

[11] Patent Number: 4,640,323

[45] Date of Patent: Feb. 3, 1987

[54] PORTABLE SYSTEM FOR FILLING BOTTLES WITH NITROUS OXIDE

[75] Inventors: John A. Norcia, Columbia; Ray Bickar, Blythewood; William M. Wheatley, Elgin, all of S.C.

[73] Assignee: Ram Automotive Company, Columbia, S.C.

[21] Appl. No.: 784,672

[22] Filed: Sep. 27, 1985

[51] Int. Cl.[4] ..... B65B 3/10

[52] U.S. Cl. ..... 141/18; 141/67; 222/394

[58] Field of Search ..... 261/DIG. 7; 141/2, 18–29, 141/4–16, 9, 11, 37, 63–69, 70, 100, 103, 104, 129–191, 192–198, 234, 236, 250–284; 222/394, 399

[56] References Cited

U.S. PATENT DOCUMENTS 4,494,488 1/1985 Wheatley ..... 123/1 A 4,499,931 2/1985 Urban ..... 141/67

*Primary Examiner*—Houston S. Bell, Jr.

*Attorney, Agent, or Firm*—Sand & Hudak Co.

[57] ABSTRACT

A portable system for filling bottles with nitrous oxide from a large supply cylinder of nitrous oxide at ambient temperature. The supply cylinder is connected by a conduit to a cylinder of inert gas which is under a considerably higher pressure than that of the nitrous oxide through a valve. The bottle to be filled is connected to the cylinder of nitrous oxide by another conduit. The inert gas through a pressure regulator maintains a blanket of high pressure inert gas above the liquid nitrous oxide in the cylinder to force the nitrous oxide from the cylinder and into the bottle. The valve when in a first position enables the cylinder of nitrous oxide to be connected to the cylinder of inert gas to maintain the pressurized blanket of gas above the nitrous oxide and then when in a second position enables the inert gas to force the nitrous oxide into the bottle. Maintaining a proper supply of inert gas above the liquid nitrous oxide permits the entire contents of the supply cylinder to be transferred to refill bottles at ambient temperature.

15 Claims, 7 Drawing Figures

PORTABLE SYSTEM FOR FILLING BOTTLES WITH NITROUS OXIDE

TECHNICAL FIELD

The invention relates to nitrous oxide and in particular to an improved system for filling small bottles with liquid nitrous oxide at ambient temperature from a larger cylinder without requiring the cooling of the cylinder and bottle and without the use of expensive pumping units.

BACKGROUND ART

Nitrous oxide when placed under a sufficient pressure will be in liquid form and is used for a variety of purposes, one of which is in high preformance vehicles such as racecars, boats or the like in order to achieve a sudden burst of power to the vehicle engine for a short period of time. The use of nitrous oxide for charging a vehicle engine is disclosed in U.S. Pat. No. 4,494,488 which is assigned to the same assignee as in the present invention. Although the use of bottles of liquid nitrous oxide in a racing vehicle or boat has proved successful in obtaining the desired results, it has presented a problem of satisfactory refilling such bottles at the site of the race or boat dock.

Heretofore, the smaller bottles which are placed in the vehicles and boats are filled with liquid nitrous oxide at an industrial supply house generally by several known procedures. One procedure involves filling the smaller bottles of nitrous oxide from a larger cylinder by connecting the two bottles with a conduit. The liquid nitrous oxide will flow from the larger cylinder to the smaller bottle by the pressure within the supply cylinder. However, to insure satisfactory transfer of the liquid nitrous oxide between the two containers and to prevent the liquid nitrous oxide from vaporizing when flowing from the larger cylinder to the smaller bottle which forms a back pressure in the bottle retarding the filling of the bottle, the bottle is cooled to a very low temperature by placing it in a freezer for several hours or by injecting a small quantity of the liquid nitrous oxide into the bottle, then releasing it from the bottle which upon vaporizing to the atmosphere will cool the bottle. Both of these known procedures result in increased costs due to the refrigeration unit required for cooling the bottle and cylinder and the loss of the nitrous oxide required for cooling the bottle since it is vented into the surrounding atmosphere. Another method of filling the bottles is by the use of a large pump which transfers the nitrous oxide from a large supply tank into the individual, preferably cooled bottles. However, the pump is relatively expensive, not portable and should be maintained in a cool state to prevent the nitrous oxide from vaporizing during transfer.

Another serious problem that occurs when filling a small bottle from a larger cylinder of nitrous oxide is that upon the pressure differential between the two containers becoming equalized approximately 20% of the nitrous oxide in the cylinder is unable to be transferred into smaller bottles. Furthermore, as the nitrous oxide in the larger cylinder becomes depleted, the amount of time required to fill the smaller bottles from the cylinder increases considerably due to equalization of the pressure.

Although it is desirable that the bottles be refilled at the racetrack, boatdock, or similar site, such locations usually provide a hot environment for the bottles and supply cylinders. These high temperatures result in the rapid vaporization of the liquid nitrous oxide during transfer with the resulting buildup of back pressure in the bottle preventing it from being satisfactory filled in a reasonable length of time. Also, it is possible to only partially empty the nitrous oxide from the supply cylinder.

During the heretofore pressure differential transfer of the liquid nitrous oxide from the cylinder into the smaller bottles, the cylinder and bottles are inverted in order to facilitate the transfer of the liquid nitrous oxide from the cylinder into smaller bottles. Although this increases the effectiveness of the transfer, it presents another problem in that contaminates within the bottle and cylinder, usually in the form of small particles of dirt or rust, will flow downwardly into the discharge nozzle or valve portion of the cylinder and into the bottle. These contaminates could cause a malfunction of the injection system on the vehicle. Furthermore, the equipment being used for effecting the transfer of the liquid nitrous oxide is difficult to use at the site of a race due to the lack of portability thereof.

Therefore, the need has existed for an improved system for filling bottles with liquid nitrous oxide from a larger supply cylinder when both the bottle and cylinder are at ambient temperature, and in which the system is completely portable enabling the same to be accomplished at a race site or other location remote from a usual industrial liquid nitrous oxide supply facility.

DISCLOSURE OF THE INVENTION

Objectives of the invention include providing an improved system for filling bottles with nitrous oxide from a larger supply cylinder of such nitrous oxide at ambient temperature, and in which the system is portable enabling the same to be transported easily to a race site or other location distant from a liquid nitrous oxide supply facility. Still another objective is to provide such an improved system which requires only a cylinder of pressurized inert gas such as nitrogen, for connection to the supply cylinder of nitrous oxide to form a pressurized blanket of inert gas above the liquid nitrous oxide in the cylinder to force it from the cylinder and into a refill bottle.

A further objective of the invention is to provide such an improved system in which the supply cylinder of nitrous oxide can be completely emptied, and in which the time required for filling the smaller bottles is relatively unaffected by the amount of liquid nitrous oxide left in the supply cylinder. Another objective is to provide such an improved filling system which requires no expensive and cumbersome pumps for effecting transfer of the liquid nitrous oxide, in which neither the supply cylinder or refill bottle need be inverted to effect a satisfactory transfer of the liquid nitrous oxide as heretofore required, in which in the inert gas does not mix with the liquid nitrous oxide enabling it to maintain its purity and composition, and in which the pressurizing inert gas is preferably nitrogen which is an extremely safe and efficient gas for use in various types of environment.

These objectives and advantages are obtained by the improved portable system of the invention which is intended for use for filling bottles with nitrous oxide, the general nature of which may be stated as including a first container holding a supply of pressurized liquid nitrous oxide; a second container holding a supply of pressurized inert gas under a greater pressure than the nitrous oxide; a third container for receiving a supply of liquid nitrous oxide from said first container; first conduit means for delivering nitrous oxide from the first container into the third container; second conduit means for delivering pressurized inert gas from the second container into the first container to form a pressurized blanket of inert gas against the liquid nitrous oxide for discharging the nitrous oxide from said first container and into the third container through the first conduit means; and valve means for directing the flow of pressurized inert gas into the first container through the second conduit means to form the pressurized blanket of inert gas and for directing the nitrous oxide from said first container and into the third container through the first conduit means.

BRIEF DESCRIPTION OF THE DRAWINGS

Preferred embodiments of the invention, illustrative of the best modes in which the applicants have contemplated applying the principles, are set forth in the following description and are shown in the drawings, and are particularly and distinctly pointed out and set forth in the amended claims.

Similar numerals refer to similar parts throughout the drawings.

BEST MODE FOR CARRYING OUT THE INVENTION

Figure 1:
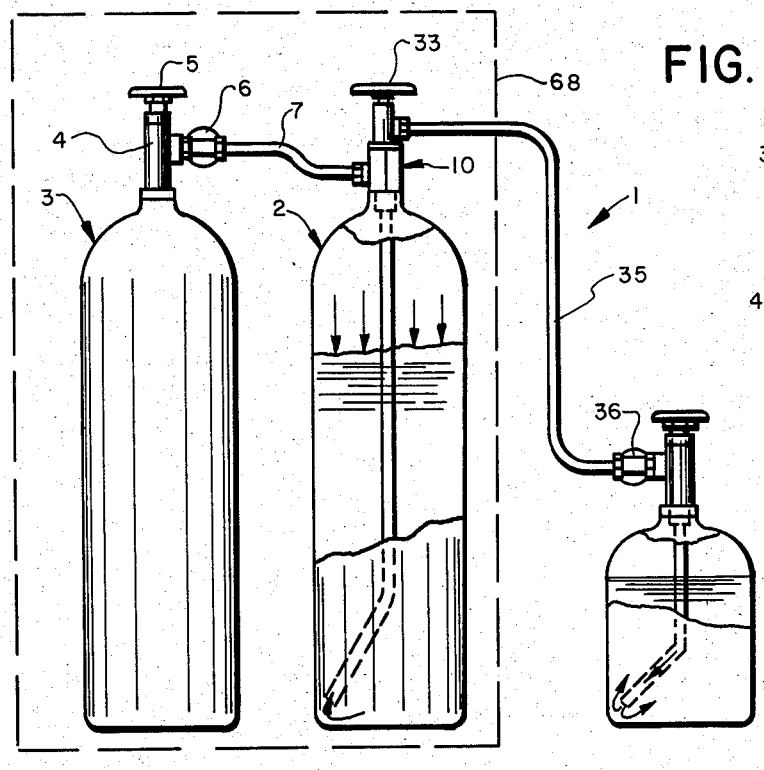
FIG. 1 is a diagrammatic elevational view with portions broken away, of the portable system for filling bottles with nitrous oxide.
Figure 2:
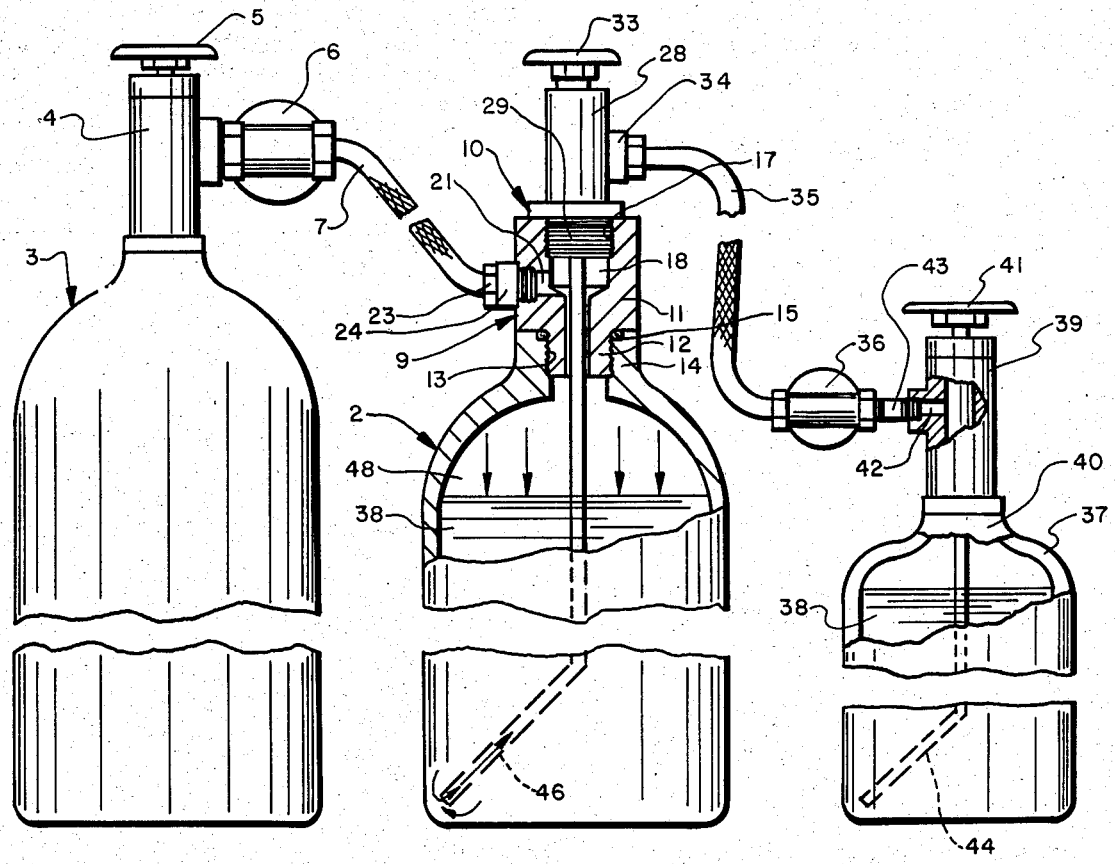
FIG. 2 is an enlarged fragmentary elevational view with portions broken away and in section, of the improved system shown in FIG. 1.

The improved portable system for filling bottles with nitrous oxide is indicated generally at 1, and is shown particularly in FIGS. 1 and 2. System 1 includes a nitrous oxide supply cylinder or container indicated generally at 2, and a cylinder 3 containing an inert gas, preferably nitrogen. A usual manually controlled valve 4 is mounted in the top opening or neck of nitrogen cylinder 3 having a rotatable handle 5. A pressure regulator valve 6 is connected to valve 4 and communicates with a section of conduit 7 which extends between cylinders 2 and 3. Conduit 7 is connected to cylinder 2 by an adapter valve assembly indicated generally at 10.

Adapter valve assembly 10 may be is similar to that shown in U.S. Pat. No. 4,494,488 or have the construction shown in FIG. 2. Assembly 10 includes an adapter portion 9 having a cylindrical body 11 formed of brass or stainless steel with an externally threaded reduced bottom end 12 which is threadably engaged within a threaded opening 13 formed in neck 14 of cylinder 2. A sealing gasket 15 preferably is mounted in a complementary shaped annular recess formed in cylinder neck 14 adjacent opening 13. The upper portion of adapter 9 is formed with an internally threaded bore portion 17 and an axially extending bore 18 which extends throughout the adapter.

A transversely extending secondary bore 21 is formed in adapter body 11 and communicates with axial bore 18. Nitrogen gas supply conduit 7 is connected to bore 21 by a coupler 23. A one-way check valve 24 is mounted in bore 21 with coupler 23 being connected thereto. Check valve 24 permits the flow of nitrogen gas into bore 18 through line 7 but does not permit the flow of any nitrous oxide either in liquid or vapor form or nitrogen from bore 18 back into cylinder 3 through conduit 7.

A usual manually actuated valve 28 is mounted in top threaded bore portion 17 of adapter 9 by a cylindrical threaded end portion 29 (FIG. 2). Threaded end 29 heretofore was intended to be threadably engaged within threaded opening 13 of cylinder 2. Valve 28 includes a usual manually actuated handle 33 and a coupler 34 for connecting a nitrous oxide fill line 35 thereto. Line 35 is connected to a detachable bottle 37 which is adapted to be filled with a supply of liquid nitrous oxide 38 from main supply cylinder 2.

Bottle 37 is a usual type of steel or aluminum container having a manually operated control valve 39 mounted in a threaded end of neck 40. Valve 39 includes a control knob 41 and an inlet-outlet port 42 to which is connected by a coupler 43 to fill line 35. A ball valve 36 preferably is mounted in line 35.

Port 42 functions both as the outlet port and inlet port for bottle 37 and is intended to be connected by another conduit (not shown) for connecting the filled bottle to the piece of equipment or apparatus such as a vehicle engine, with which it is intended to be used. Port 42 communicates with a siphon tube 44 which extends to the bottom of bottle 37 through which the liquid nitrous oxide is subsequently discharged through port 42.

The operation of the improved system is best illustrated by reference to FIGS. 1 and 2. A nitrous oxide pickup tube 46 which extends from adjacent the bottom of cylinder 2 upwardly through the cylinder, is connected to valve 28 at its lower end. Tube 46 has a smaller diameter than that of axial bore 18 so as to form an annular space between the tube and interior walls of adapter 9. Cylinder 2 will contain a supply of liquid nitrous oxide pressurized at an initial pressure of approximately 900 psi. Valve 28 will be in an open position with supply line 35 being connected to port 42 of bottle 37 with valve 39 also being in an open position. In accordance with one of the main features and advantages achieved by the invention, both cylinder 2 and bottle 37 will be at ambient temperature. Conduit 7 is connected to bore 21 with check valve 24 preventing the flow of any gaseous or liquid material present in cylinder 2 from flowing into conduit 7.

Cylinder 3 contains a supply of inert gas, preferably nitrogen, under a pressure of approximately 2400 psi. Regulator 6 will have an output pressure of approximately 1100 psi. Opening of valve 4 by manually operated handle 5 will enable the nitrogen gas to flow through regulator 6 and into cylinder 2 through conduit 7. The incoming nitrogen gas flows through secondary bore 21 and through the annular space formed between the exterior of delivery tube 46 and interior of cylindrical body 11 and threaded bottom end 12 and into the upper void portion 48 of cylinder 2 located above the level of liquid nitrous oxide 38. This nitrogen gas forms a pressurized blanket of the gas above the liquid nitrous oxide as shown by the arrows in FIG. 2 which will force the nitrous oxide up through delivery tube 46 and into delivery line 35. The liquid nitrous oxide will flow through open valve 39 and down through siphon tube 44 and into the interior of bottle 37. The nitrogen will continue to force the liquid nitrous oxide from cylinder 2 into bottle 37 until bottle 37 is filled, after which valves 28 and 39 will be closed by manual manipulation of handles 33 and 41, respectively.

When filling bottle 37 it will be placed on a scale which will indicate when the bottle has been filled to the desired level. For example, a usual nitrous oxide bottle 37 will weigh approximately 15 pounds when empty and will weigh approximately 25 pounds when filled with liquid nitrous oxide. Thus, the amount and correspondingly the level of nitrous oxide in bottle 37 is easily ascertained by reading an indicating dial on a scale supporting bottle 37 while it is being filled.

Due to the difference in pressure between the nitrogen in cylinder 3 and the nitrous oxide in cylinder 2, sufficient pressure will be available to force all of the liquid nitrous oxide from container 2 into refill bottles 37. Thus, even though the level of liquid nitrous oxide drops in cylinder 2, the pressure exerted by the nitrogen gas will still remain generally constant throughout the emptying of cylinder 2 providing for a uniform flow rate of the liquid nitrous oxide from cylinder 2 into bottles 37. Cylinder 2 also can be placed on a scale which will indicate when the bottle is near empty due to the decrease in the weight of the cylinder. The liquid nitrous oxide flowing from cylinder 2 into bottle 37 will be maintained in a liquid state with very little vaporization occuring since a high pressure can be maintained throughout the transfer of the liquid nitrous oxide due to the pressurizing effect or blanket created by the higher pressure of the nitrogen gas.

Figure 3:
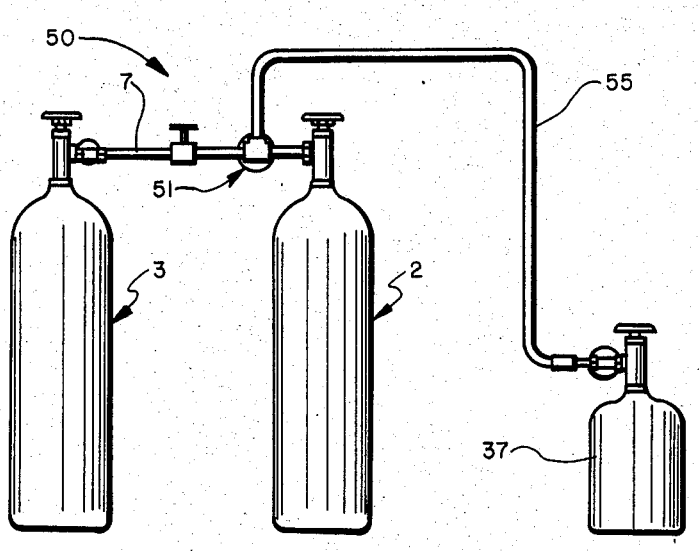
FIG. 3 is a diagrammatic elevational view similar to FIG. 1 showing a modification to the system for filling bottles with nitrous oxide shown in FIG. 1.
Figure 4:
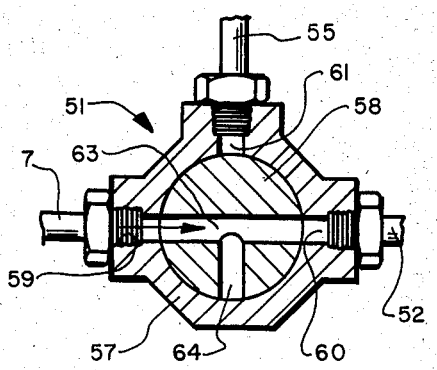
FIGS. 4 and 5 are enlarged fragmentary sectional views of the two-way valve component of FIG. 3.
Figure 5:
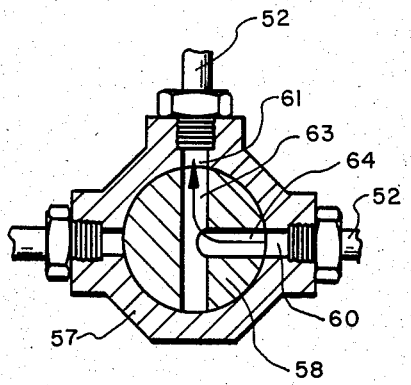

A modified form of the improved portable system for filling bottles with liquid nitrous oxide at ambient temperature is indicated generally at 50 and is shown in FIGS. 3–6. System 50 is similar to system 1 described above except for the mounting of a two-way valve indicated at 51 in conduit 7. Valve 51 is connected by a conduit 52 to an inlet passage 53 of a valve 54 similar to valve 39 described above with respect to bottle 37. A nitrous oxide supply line 55 similar to supply line 35 extends between bottle valve 39 and valve 51. Valve 51 may have various configurations, one of which is shown in detail in FIGS. 4 and 5. Valve 51 includes a valve body 57 having a spherical ball 58 moveably mounted therein. Valve body 57 is formed with three inlet openings, an inert gas opening 59, and a pair of nitrous oxide openings 60 and 61 which are connected to conduits 7 and 52, and feed line 55, respectively. Ball 58 is formed with a diametrically extending passage 63 which extends completely through the ball, and a secondary passage 64 which communicates with passage 63 as shown in FIGS. 4 and 5.

Figure 6:
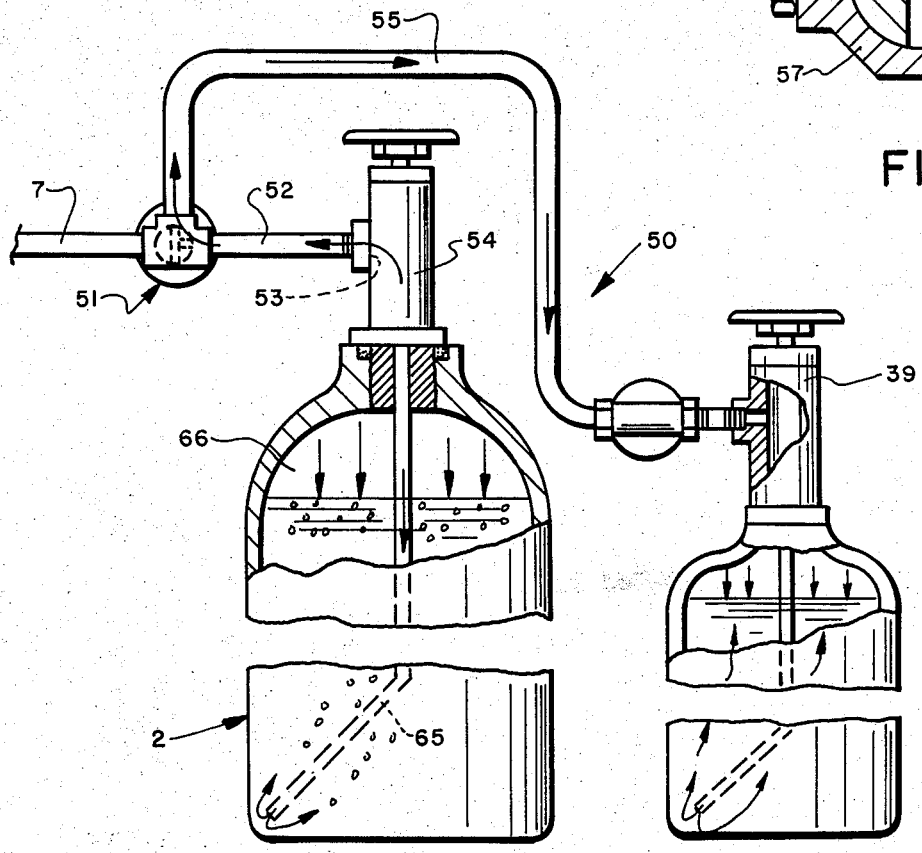
FIG. 6 is an enlarged fragmentary diagrammatic view similar to FIG. 2 of the modified system of FIG. 3.

The operation of modified system 50 is shown particularly in FIGS. 3 and 6. Valve 51 will be placed in the position shown in FIG. 4 in which position passage 63 provides a flow path between openings 59 and 60 and correspondingly conduits 7 and 52. In this position, the nitrogen gas will flow from cylinder 3 through conduits 7 and 52 and into the top of valve 54. A tube 65 extends from valve 54 to the bottom of cylinder 2 and the nitrogen gas will flow through tube 65 and bubble upwardly through the liquid nitrous oxide into void area 66 where it forms the blanket of pressurized nitrogen gas as shown in FIG. 2 for system 1. With this modified system, valve 54 replaces adapter valve assembly 10 used with system 1 shown in FIG. 2.

After the blanket of gas has been formed above the liquid nitrous oxide, ball valve 58 is moved from the position of FIG. 4 to that of FIG. 5 in which position passage 63 will communicate with opening 61 and passage 64 will communicate with opening 60 whereby the nitrogen gas blanket will force the liquid nitrous oxide upwardly through tube 65, valve 54 and conduit 52 and through passages 64 and 61 and feed line 55 and then into bottle 37 for filling the same. Depending upon the level of the liquid nitrous oxide in cylinder 2, a single charge of nitrogen gas in void area 66 may be sufficient to transfer the desired amount of liquid nitrous oxide from cylinder 2 into bottle 37. Should the pressure of the nitrogen gas decrease appreciably slowing down the transfer of the liquid nitrous oxide between cylinder 2 and bottle 37, valve 51 can be moved from the position of FIG. 5 to that of FIG. 4 shutting off the transfer of liquid nitrous oxide into bottle 37 and permitting void area 66 to be recharged with another supply of pressurized nitrogen gas in the manner described above. After recharging cylinder 2 with the nitrogen gas valve 51 is merely moved back to the position of FIG. 5 whereby the liquid nitrous oxide will flow between cylinder 2 and bottle 37.

Therefore, by simple manipulation of valve 51, cylinder 2 can be pressurized as required to provide for a continuous flow of the liquid nitrous oxide from cylinder 2 into bottle 37. Again the above transfer procedure is performed at ambient temperatures since the pressure of the nitrogen provides for continuous and smooth transfer of the liquid from main supply cylinder 2 into refill bottles 37 by simple manipulations of the various valves on the cylinders and bottles as described previously. Accordingly, the improved system provides for the rapid and complete filling of bottles with liquid nitrous oxide from a main supply cylinder by the use of a pressurizing inert gas, preferably nitrogen, wherein the cylinders and bottles can be at ambient temperatures and need not be cooled as heretofore required and without the use of expensive pumps, storage and handling equipment and without inverting the bottles as heretofore required. Also cylinders 2 and 3 can be mounted on a readily moveable cart or the like represented by dash lines 68 in FIG. 1 increasing the mobility at a racetrack, boat dock or similar location. Scales for measuring the weight and correspondingly the volumes of cylinder 2 and bottle 37 may be provided in such a cart or transparent unit.

Figure 7:
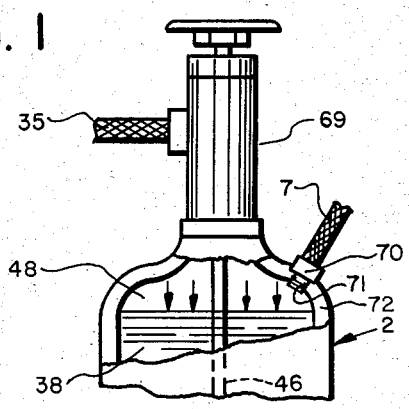
FIG. 7 is a fragmentary sectional view showing a modification to the nitrous oxide supply cylinder used in the improved system.

A modification to the equipment for use in the improved system of the invention is shown in FIG. 7. Nitrous oxide cylinder 2 is provided with a usual manually actuated valve 69 mounted in the threaded neck thereof. Valve 69 is similar to valve 39 shown mounted in the nitrous oxide bottle 37 of FIGS. 2 and 6. In modification of FIG. 7, a one-way check valve 70 is mounted within an opening 71 formed in an upper portion of cylinder wall 72 and is connected to nitrogen supply conduit 7. This arrangement enables the incoming nitrogen to form the blanket of pressurized nitrogen above the liquid nitrous oxide in a similar manner as described above and shown in FIG. 2. The main difference is that a usual manually actuated valve 69 replaces adaptor valve assembly 10 as shown in FIG. 2. Nitrous oxide feed line 35 is connected to the outlet port of valve 69 so that upon the opening of valve 69 the pressurized blanket of nitrogen forces the liquid nitrogen oxide up through tube 46 and through line 35 and into a supply bottle 37.

Furthermore, if desired, siphon tube 46 can be eliminated in nitrous oxide cylinder 2 by inverting cylinder 2 and permitting the blanket of nitrogen to bubble up through the liquid nitrous oxide to form the pressurized blanket between the bottom of the cylinder which then becomes the top, enabling it to force the liquid nitrous oxide through valve 69 and into supply line 35. However, in this arrangement, supply cylinder 2 must be inverted but will still perform satisfactorily for the transfer of liquid nitrous oxide therefrom into supply bottle 37.

Accordingly, the improved system is simplified, provides an effective, safe, inexpensive, and efficient arrangement which achieves all the enumerated objectives, provides for eliminating difficulties encountered with prior systems, and solves problems and obtains new results in the art.

In the foregoing descrition, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved system for filling bottles with liquid nitrous oxide is constructed and used, the characteristics of the system, and the advantageous, new and useful results obtained; the new and useful structures, devices, elements, arrangements, parts, and combinations are set forth in the appended claims.

What is claimed is:

1. A portable system for filling bottles with nitrous oxide including:

(a) a first container holding a supply of pressurized liquid nitrous oxide;

(b) a second container holding a supply of pressurized inert gas under a greater pressure than the nitrous oxide;

(c) a third container for receiving a supply of liquid nitrous oxide from said first container;

(d) first conduit means for delivering nitrous oxide from the first container into the third container;

(e) second conduit means for delivering pressurized inert gas from the second container into the first container to form a pressurized blanket of inert gas against the liquid nitrous oxide for discharging the nitrous oxide from said first container and into the third container through the first conduit means; and (f) valve means for directing the flow of pressurized inert gas into the first container through the second conduit means to form the pressurized blanket of inert gas and for directing the nitrous oxide from said first container and into the third container through the first conduit means, wherein said valve means is a two-position valve which enables the first container to be alternatively connected to the second and third containers through the second and first conduit means, respectively.

2. The system defined in claim 1 in which the inert gas is nitrogen.

3. The system defined in claim 1 in which a one way check valve is associated with the second conduit means preventing the flow of nitrous oxide from the first and third containers into the second container.

4. The system defined in claim 1 in which the pressurized inert gas is at a pressure of approximately 2400 psi.

5. The system defined in claim 1 in which the pressurized nitrous oxide in the first container is placed under a pressure of approximately 1100 psi by the blanket of inert gas.

6. The system defined in claim 1 in which the first, second and third containers are at ambient temperature.

7. The system defined in claim 1, wherein said two way valve has a diametrically extending passage extending therethrough, a secondary passage communicating with said diametrically extending passage, said diametrically extending passage capable of providing a flow path between said first and said second containers.

8. The system defined in claim 7, wherein said secondary passage in association with said diametrically extending passage is capable of providing a flow path between said first and said third container.

9. The system defined in claim 8, wherein said two way valve has a body, a ball moveably mounted in said valve body, and said diametrically extending passage and said secondary passage located in said moveable ball.

10. The system defined in claim 7, in which a one way check valve is associated with the second conduit means preventing the flow of nitrous oxide from the first and third containers into the second container.

11. The system defined in claim 8, wherein a one way check valve is associated with the second conduit means preventing the flow of nitrous oxide from the first and third containers into the second container.

12. The system defined in claim 9, in which a one way check valve is associated with the second conduit means preventing the flow of nitrous oxide from the first and third containers into the second container.

13. The system defined in claim 7, in which the first, second and third containers are at ambient temperature.

14. The system defined in claim 10, in which the first, second and third containers are at ambient temperature.

15. The system defined in claim 11, in which the first, and second and third containers are at ambient temperature.

* * * * *